United States Patent [19]

Köhnen et al.

[11] Patent Number: 4,818,252

[45] Date of Patent: Apr. 4, 1989

[54] ARRANGEMENT FOR GASIFYING FINELY DIVIDED PARTICULARLY SOLID FUEL UNDER HIGH PRESSURE

[75] Inventors: Klaus Köhnen, Ruhr; Hans Niermann, Essen; Hans C. Pohl, Witten, all of Fed. Rep. of Germany

[73] Assignee: Krupp Koppers GmbH, Essen, Fed. Rep. of Germany

[21] Appl. No.: 29,535

[22] Filed: Mar. 23, 1987

[30] Foreign Application Priority Data

Apr. 22, 1986 [DE] Fed. Rep. of Germany ..... 3613508

[51] Int. Cl.[4] ..... C10J 3/48

[52] U.S. Cl. ..... 48/67; 48/76; 48/77; 122/6 A; 122/235 K

[58] Field of Search ..... 48/62 R, 63, 64, 67, 48/69, 76, 77; 122/64, 5, 6.6, 7 R, 367 R, 10, 367 A, 235 B, 235 A, 235 K

[56] References Cited

U.S. PATENT DOCUMENTS

| | | | |
|---|---|---|---|
| 3,233,597 | 2/1966 | Svendsen | 122/235 B |
| 3,712,602 | 1/1973 | Brown et al. | 122/66 |
| 4,013,427 | 3/1977 | Gemhardt et al. | 48/67 |
| 4,394,849 | 7/1983 | Pratt et al. | 122/235 A |
| 4,524,727 | 6/1988 | Ammann | 122/235 K |

FOREIGN PATENT DOCUMENTS

| | | | |
|---|---|---|---|
| 968423 | 2/1958 | Fed. Rep. of Germany . | |
| 1076868 | 9/1960 | Fed. Rep. of Germany . | |
| 2038445 | 6/1978 | Fed. Rep. of Germany . | |
| 2425962 | 8/1978 | Fed. Rep. of Germany . | |
| 3617773 | 12/1986 | Fed. Rep. of Germany | 48/77 |

*Primary Examiner*—Peter Kratz

*Attorney, Agent, or Firm*—Michael J. Striker

[57] ABSTRACT

An arrangement for and a method of gasifying finely divided, particularly solid fuel under increased pressure with a multi-pipe wall having a plurality of pipes arranged to be supplied with a cooling medium, the multi-pipe wall limiting a gas-collecting chamber and also limiting a plurality of recesses which form combustion chambers, wherein each of the recesses having a plurality of parameters including a depth, a width and an angle of inclination of a peripheral wall and being such that at least one of the parameters is changeable

19 Claims, 10 Drawing Sheets

ARRANGEMENT FOR GASIFYING FINELY DIVIDED PARTICULARLY SOLID FUEL UNDER HIGH PRESSURE

BACKGROUND OF THE INVENTION

The present invention relates to an arrangement for and a method of gasifying finely divided, particularly solid fuel under high pressure.

Arrangements and methods of the above mentioned general type are known in the art. A known arrangement for gasifying finely distributed, particularly solid fuel under high pressure includes a gas collecting chamber with an upper gas outlet and a lower gas outlet, wherein one or several combustion chambers formed as recesses are arranged on the gas collecting chamber, and the gas collecting chamber and the recesses are limited by a multi-pipe wall which is subjected to the action of cooling means.

The arrangement of the above described construction is disclosed, for example, in the German document DE-PS No. 2,038,445. It is also known in the gasifying arrangement provided with refractory coating, to connect the recesses either non-releasable with the collecting chamber as disclosed in the German document DE-PS No. 968,423, or to provide a releasable connection as disclosed in the German document DE-PS No. 1,076,868. It is finally also known during the gasifying under high pressure after approximately 100 bar to release the tubular of the gas collecting chamber and recesses in a common pressure vessel for pressure equalization, as disclosed in the German document DE-AS 2,425,962. The intermediate space between the pressure vessel and the multi-pipe wall structure can be filled with an insulating material and subjected to the action of the inert gas.

In the combustion chambers which are formed as recesses, the gasification process takes place, or in other words, the reaction of the fuel with oxygen-containing gases and in some cases water steam with temperatures which can reach up to 2000° C. It has been recognized that the shape or size of the recesses selected for the conception of a gasifying arrangement is not possible for all operational conditions. Moreover, it has been determined that depending on the type of fuel, speed of gasification, temperature of gasification and other operational parameters, different sizes of recesses are desirable.

SUMMARY OF THE INVENTION

Accordingly, it is an object of the present invention to provide a gasifying arrangement of the described type, which avoids the disadvantages of the prior art.

More particularly, it is an object of the present invention to provide gasifying arrangement of the above mentioned general type, which is formed so that it is adaptable to respective operational conditions with such time and investment costs which are as low as possible.

In keeping with these objects and with others which will become apparent hereinafter, one feature of the present invention resides, briefly stated, in the arrangement in which the depth and/or the width of each recess and/or the angle of inclination of the recess wall are changeable in accordance with operational conditions.

The present invention resides in the method in accordance with which the depth and/or the width of each recess and/or the angle of inclination of the recess wall are changeable in accordance with operational conditions.

When the gasifying arrangement is designed and method is performed in accordance with the present invention, it eliminates the disadvantages of the prior art and achieves the above mentioned objects.

In accordance with another feature of the present invention, the depth of the recesses are changeable by insertion of a vertical pipe wall at different distances from the wall of the gas collecting chamber.

Still another feature of the present invention is that the width of the recesses can be adjusted so that the recess walls of different diameters can be inserted into the wall of the gas collecting chamber.

It is another feature of the present invention is that the angle of inclination of the recess wall can be changed by insertion of inclined walls into the wall of the gas collecting chamber.

A further feature of the present invention is that the recess wall can be formed by a respectively bent pipes of the multi-pipe wall of the gas accumulating chamber. In other words, it can be integrated in the multi-pipe wall structure of the gas collecting chamber and form part of the cooling system of this multi-pipe wall structure. In this embodiment naturally only the depth of the recesses can be changed.

In deviation from this embodiment, another proposal of the invention is that the multi-pipe wall structure holds the recess wall releasably from the multi-pipe wall structure of the gas collecting chamber and has an independent cooling system. This recess wall can be formed as pipes which are welded to one another and arranged in a spiral-shaped manner or in parallel ring positions. The pipes can extend also radially or along the wall.

In the embodiment with the releasable recess walls, the tubular wall of the gas collecting chamber is provided with a throughgoing point to permit placement of the tubular wall structure of the recess wall.

The throughgoing point can be formed by bending of the pipe of the multi-pipe wall structure of the gas collecting chamber with a tubular collar. Instead of this, in the region of the throughgoing point, the region of the multi-pipe wall structure of the gas accumulating chamber can open to a collecting pipe before the throughgoing point. It is further possible in the throughgoing point to make the pipe of the multi-pipe wall structure of the gas collecting chamber to be opened into a collecting pipe which forms the periphery of the throughgoing point. Finally, the pipe of the multi-pipe wall structure of the collecting chamber can be open in the region of the throughgoing point into an annular shaped piece.

In accordance with still a further feature of the present invention, the periphery of the throughgoing point is provided with a sealing system for sealing the recess wall relative to the gas collecting chamber. The constructions and types of the arrangements of the sealing system can be different.

In accordance with a further important feature of the present invention, the throughgoing point can be closable by a cover plate provided with a cooling pipe. For protecting of the burners arranged in the cover plate, it is recommended to provide a slag-collecting protecting shield. This protecting shield can be formed advantageously from a tubular piece projecting from the cover plate and preferably coated with a layer of a fire resistant (refractory) material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

An arrangement for gasifying finely divided, particularly solid fuel which is under high pressure in accordance with the present invention includes a gas collecting chamber with a cylindrical wall. As can be seen from FIG. 1, a recess which has the shape of a truncated cone extends through the cylindrical wall of the gas collecting chamber at an angle of substantially 90°. The truncated cone has a depth H and radii $R_1$ and $R_2$, and is formed from the pipes of a multi-pipe wall of the gas collecting chamber, by bending out.

Figure 1:
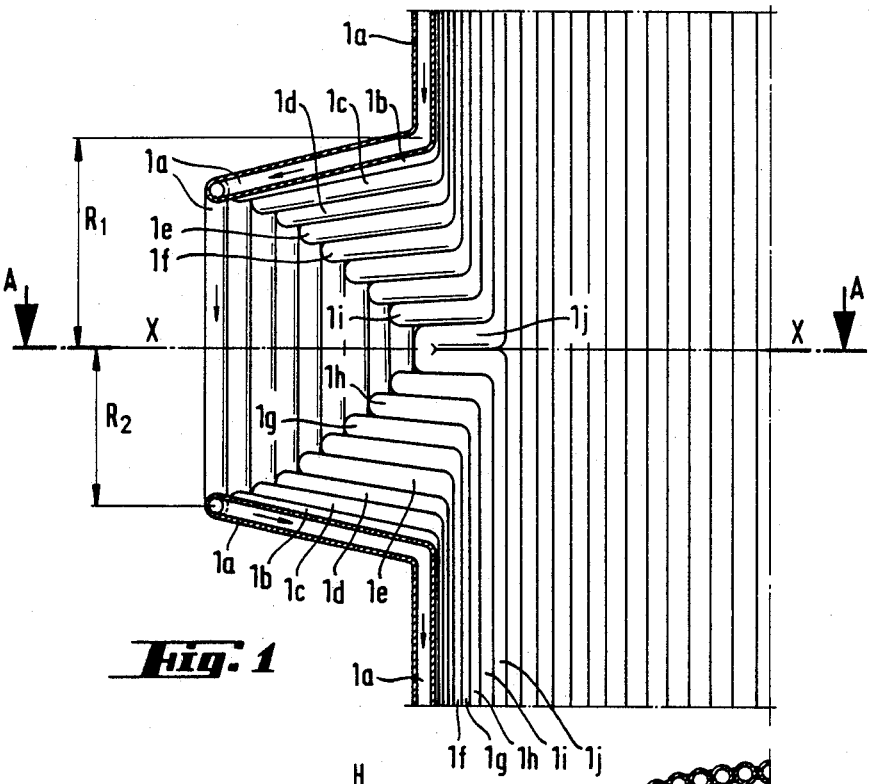
FIG. 1 is a side view showing a gasifying arrangement in accordance with the present invention, in which recess walls are formed from pipes of multi-pipe wall construction of the gas collecting chamber.
Figure 1A:
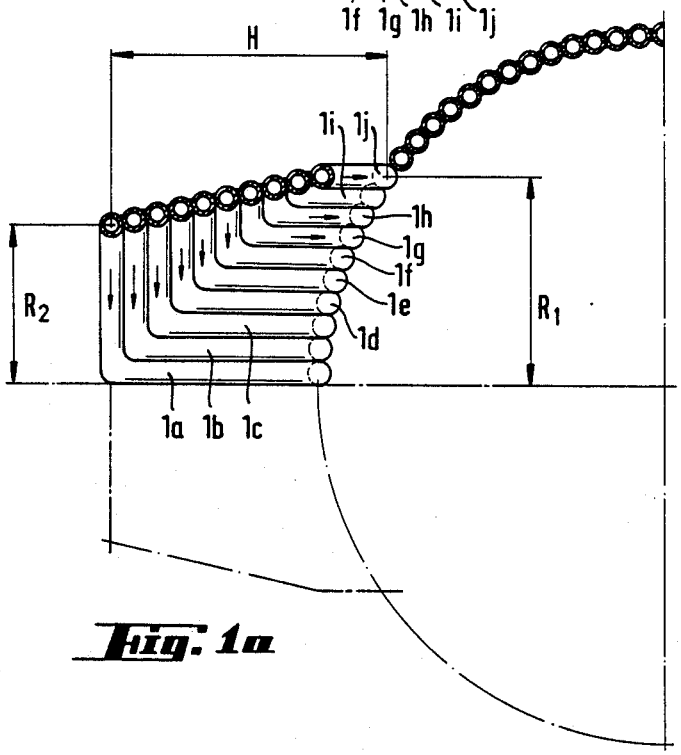
FIG. 1*a* is a view showing a partial section taken along the line A—A in FIG. 1.

As can be seen from FIGS. 1 and 1*a*, the individual pipes of the cylindrical multi-pipe structure form an outer surface of the truncated cone of the recess. For example, the pipe 1a of the vertical downwardly directed row leaves the cylindrical multi-pipe structure at the height of the throughgoing point between the truncated cone and the cylinder, bends down at an angle corresponding to the inclination of the truncated cone, runs along the peripheral line of the truncated cone until it reaches the radius $R_2$, forms on the upper small circle of the truncated cone the half circumference pipe $\pi \cdot R_2$, then again runs downwardly along the peripheral line to the lower throughgoing point, and then opens into an original vertical downwardly directed row of the cylindrical multi-pipe structure.

In this manner, the pipe 1*a* forms a part of the outer contour of the conical recess. The pipes 1*b*–1*i* run substantially the same way and form the outer surface of one recess half, while the other half is formed by the same number of pipes which are not shown in FIGS. 1 and 1*a*.

The pipes of the cylindrical multi-pipe structure and the truncated-cone recess, therefore, form a unitary pipe system. Each individual pipe forms a piece of the recess, all pipes together abut against one another and are tightly welded so as to form the whole recess. Both recess halves are also welded together in a gas-tight manner.

The depth of the recess can be increased by welding with not-shown webs between individual pipes in a certain, extremely responsive periphery, or by preset separately supplied pipe.

The incorporation of the recess in the water supply system of the cylindrical multi-pipe wall is especially advantageous, since low pressure losses take place, and an additional falling and raising conduits and inlet and outlet collectors which are required in conventional structures are dispensed with.

The above described recess which is formed by pipe loops is closed by a cover disk not shown in FIGS. 1 and 1*a*. It is applied onto the burner aggregate for gasification of the fuel.

For operation of the gasifying arrangement it is advantageous to change the size of the recess in dependence upon the of fuel, the speed of gasification, the temperature of the gasification, the composition of gases as examples of operating parameters. This can be achieved in an advantageous manner by recess inserts which can change the depth of the recess.

Figure 2:
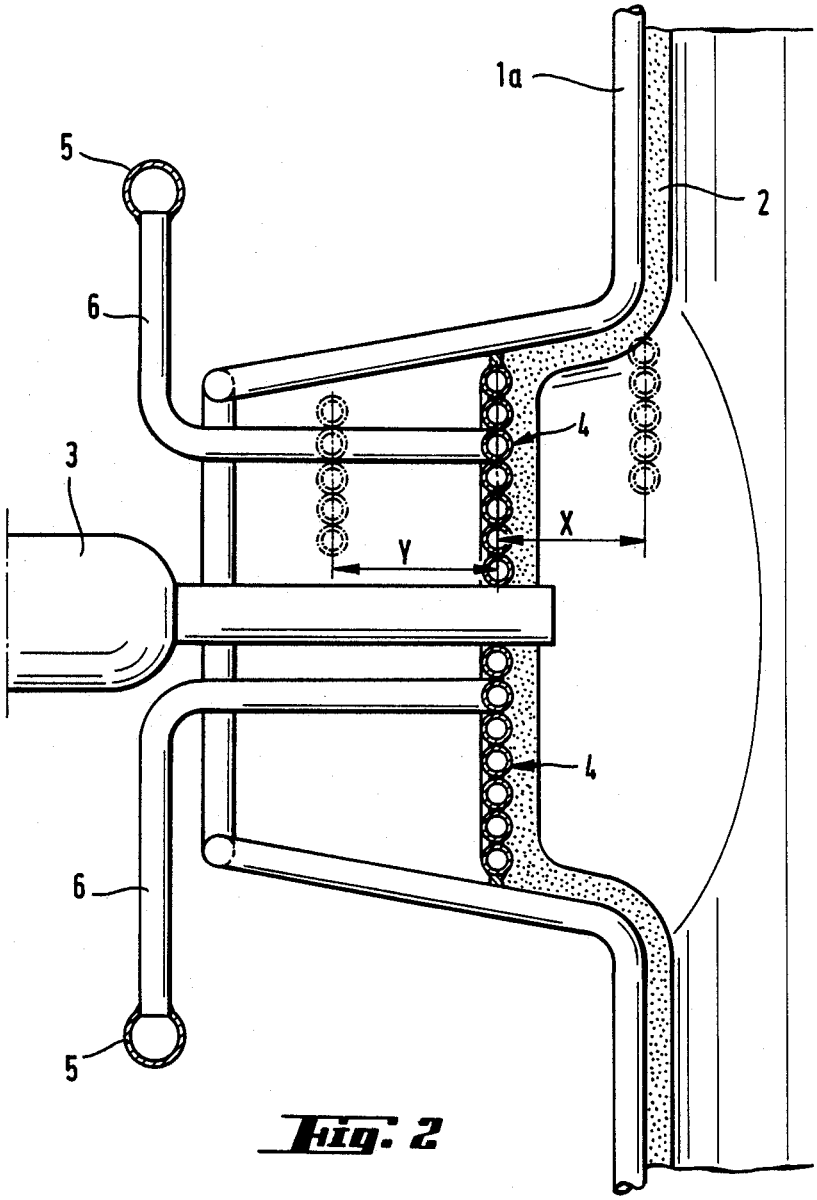
FIG. 2 is a view showing a different construction of a multi-pipe wall in the recess of FIG. 1.

FIG. 2 shows a proposal for three different inserts. The recess is formed, as shown in FIG. 1, of a plurality of pipes, with only one pipe 1a shown in the drawing. A layer of fire-resistant (refractory) material is applied on the pipe for protection purpose. A burner 3 extends into the recess and is closed by a vertical multi-pipe wall 4 which is also coated by a fire-resistant material. Water which is required for cooling the multi-pipe wall 4 is supplied to and withdrawn from the same through a collecting pipe 5 via knee pieces 6.

When a reduction of the gasifying recess is required, the recess insert with the multi-pipe wall 4 and the protector of fire-resistant material, the burner 3 and the collecting pipes 5 for water supply and withdrawal are removed and replaced a larger recess insert also with a protected multi-pipe wall, so that now the recess has the distance x from the multi-pipe wall 4. When, to the contrary, the recess is to be increased, a smaller recess insert is selected so that the recess forms the distance y from the respective position of the multi-pipe wall 4.

By the selection of a recess insert of a respective size and position, any advantageous recess size can be provided in dependence upon the operational parameters by changing the depth H of the recess as shown in FIG. 1.

Figure 3:
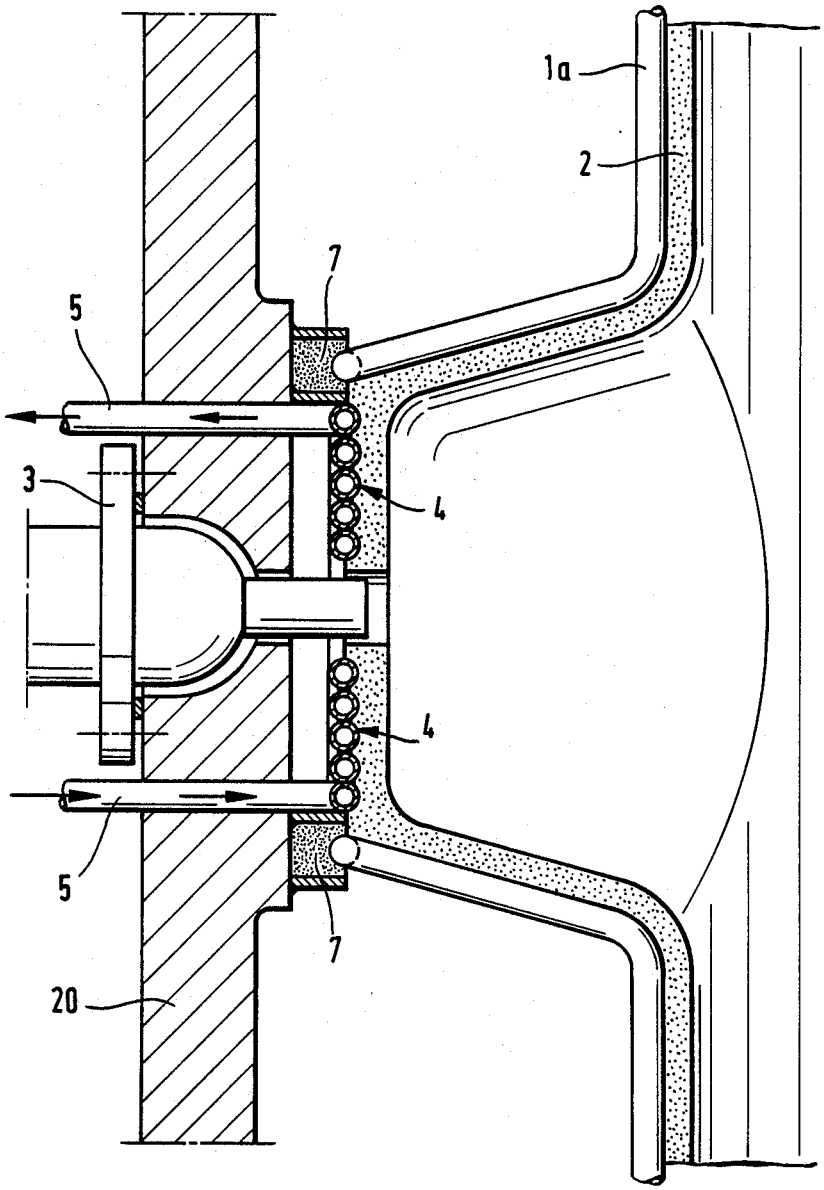
FIG. 3 is a view showing a section through the recess of FIG. 2 with a cover plate.

As defined in FIG. 3 the recess with the reaction chamber for the gasification is closed by a cover plate 20 from an outer space in which an atmospheric pressure takes places as compared with the increased gasification pressure. The cover plate is not shown in FIGS. 1 and 2 for simplification. It forms a detachable unit with the inserted burner 3. Since it is not cooled itself, it has as thermal protection the multi-pipe wall 4 with protection of fire-resistant material, which simultaneously forms the recess closure in accordance with the embodiment of FIG. 2. Supply and withdrawal of the multi-pipe wall cooling water is performed through the pipes 5.

For gas-tightly closing the recess chamber for the gasification relative to the intermediate phase between the inner chamber of the multi-wall structure and the atmospheric space, the cover plate is provided with the sealing system 7. This sealing system includes two welded concentric rings which form an intermediate space filled with heat-resistant elastic sealing mass. Gas-tightness is provided by pressing of the plate with the burner 3 against the pipe 1a which is pressed into the sealing mass. When the direction chamber for the gasification must be changed, the proposal shown in FIG. 2 can be used.

A fixation of the construction of the recess wall in accordance with FIGS. 1–3, can be not advantageous from the above presented reasons during building a gasification device for the later operation. The invention also proposes the deviation from the embodiment of FIGS. 1–3 in which the recess is created in the multi-pipe wall of the gas accumulating chamber. It provides a cylindrical multi-pipe wall in which only throughgoing openings are arranged, in which the recesses of different diametrical construction can be inserted. In this case not only the depth of the recesses can be changed in accordance with the embodiment of FIGS. 1–3, but also when necessary, their width and the angle of inclination of the recess wall can be changed as well.

Figure 4:
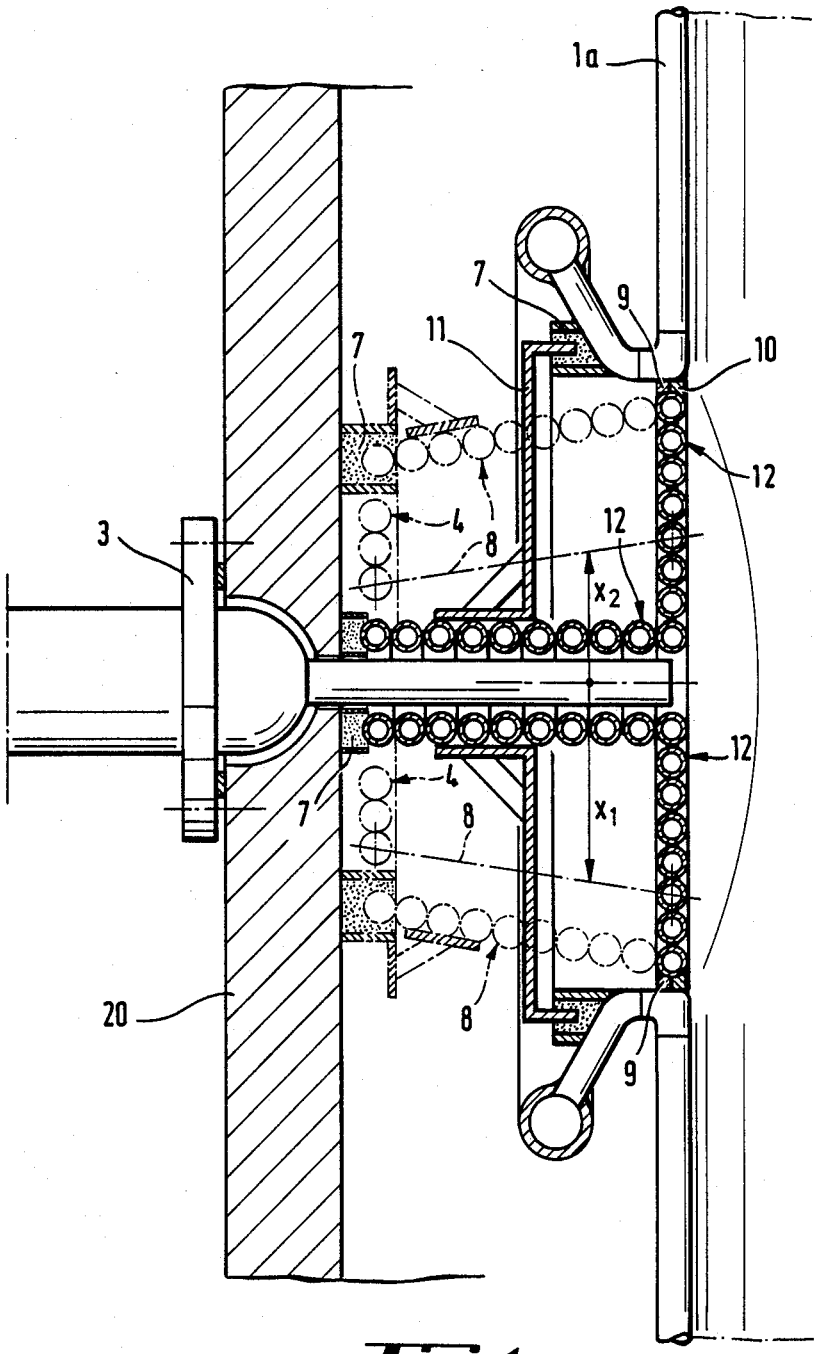
FIG. 4 is a view showing a recess with a cooling system cooperating with multi-pipe wall structure of the gas collecting chamber, wherein the width and the angle of inclination are changeable.

The recess of the above described type with changeable width and changeable angle of inclination is shown in FIG. 4. A multi-pipe body 12 forms a smallest recess. With the smallest recess formed by the multi-pipe body 12 and a recess formed as identified with reference numeral 8, there are a plurality of widths and angles of inclination when the width of the recess can be changed in direction of the arrow X. In the inserted structure, the upper part of the multi-pipe body 12 moves in the direction of the arrow to the multi-type body 8.

The gasification recess is formed by the truncated cone-shaped multi-pipe body 8 which can be made spirally or by parallel pipes. At the throughgoing point in the multi-pipe wall, the multi-pipe body 8 with the welded ring 9 abuts against an abutment 10 which is nonreleasably mounted in the throughgoing opening. The multi-pipe body 8 is guided by a ring which is welded to it and composed of an iron angle 11. The free leg of the angle 11 engages in the sealing system 7 mounted in the region of the throughgoing opening on the cylindrical multi-pipe wall and, therefore, provides a gas-tight closure. A further sealing system 7 is provided on the cover plate 20 with the burner 3.

In the above described embodiment of FIG. 4 with not-integrated recesses, it is also possible to change only the depth of the recess, as is the case in the embodiment of FIG. 2 with the integrated recess. For this purpose the horizontal multi-pipe wall which closes the recess (see reference numeral 4 in FIG. 2), can be replaced by another multi-pipe wall in respectively offset position.

In deviation from the radial extension of the pipes of the multi-pipe body 8 in FIG. 4, it is to be understood that also a longitudinal extension of the cooling-water supplying pipes of the multi-pipe body can be provided. FIG. 4 does not show connections for cooling water supply and withdrawal, however, they substantially correspond to those of FIG. 2.

A gasifying arrangement provided with a cylindrical multi-pipe wall and having no integrated recesses, must be provided with throughflow points for exchangeable recesses, so that the recesses are guided through these points and abut against an abutment as shown in FIG. 4.

For forming these throughgoing points, the individual pipes which form the cylindrical multi-pipe wall are bent from their original position and release respective openings. One of the possible embodiments of this concept is shown in FIGS. 5–7.

Figure 5:
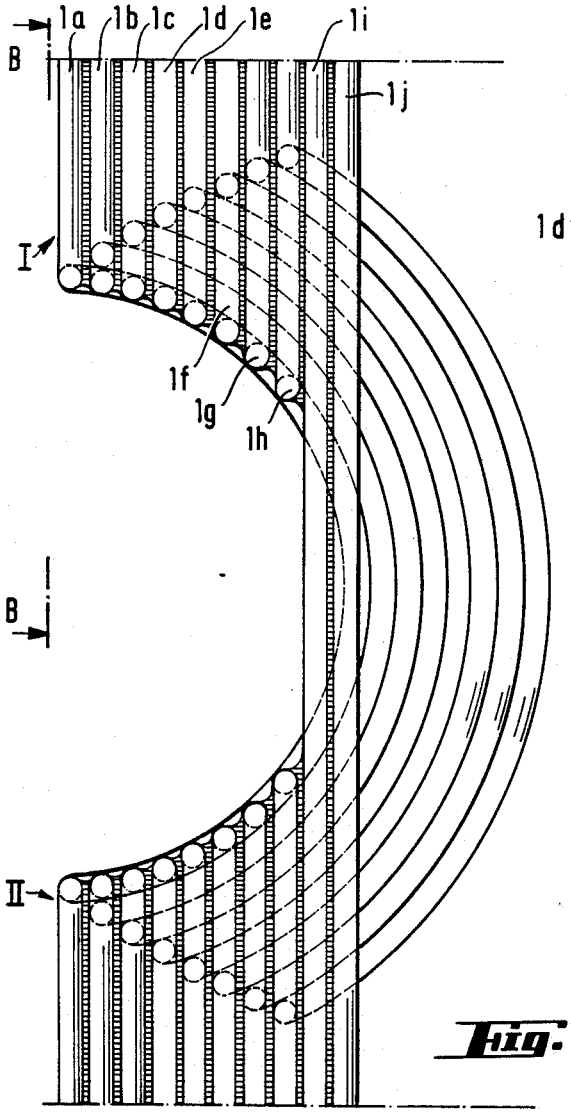
FIG. 5 is a view showing a throughgoing point of the recess in the multi-pipe wall structure of the gas collecting chamber.

In FIG. 5 the pipes 1*a*–1*j* of the upper half of the multi-pipe wall run vertically downwardly. At the point at which the periphery of the throughgoing location must be provided, they are bent from the vertical downward row line at an angle of maximum 90° from the gas side toward the burner. This provides the throughgoing point in the upper half I and and in the lower half II. When the free leg of the bent pipe angle reaches the length C in FIGS. 6 and 7, they deviate in direction of the periphery of the throughgoing point and run parallel to the throughgoing point at the distance C over a half circumference, as shown in FIG. 5, for opening in the lower half II in opposite row sequence into the multi-pipe wall.

Figure 7:
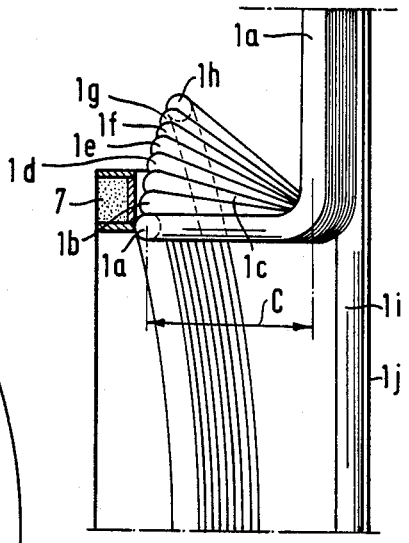
FIG. 7 is a view showing a section takén along the line B—B in FIG. 5.
Figure 6:
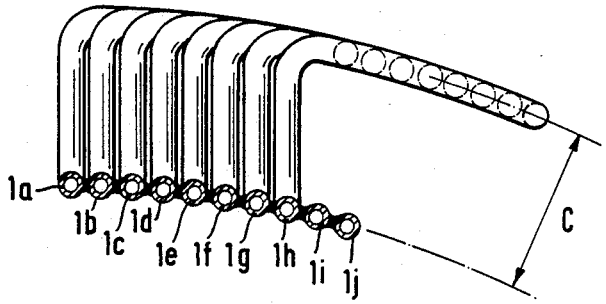
FIG. 6 is a partial plan view of the throughgoing point of FIG. 5.

In this manner, the pipes 1*a*–1*h* of the multi-pipe wall form a pipe collar in FIGS. 6 and 7, while the pipes 1*i* and 1*j* extend without deviation in the vertical downwardly extending row line of the cylindrical multi-pipe wall.

The sealing systems 7 can be arranged on the pipe collars 1*a*–1*h*, so that the inserted recesses with the cover plate and the burner can be adjusted in a not shown gas-tight manner as described hereinabove. As indicated in FIG. 5 by broken lines between the pipes, the whole cylindrical multi-pipe wall structure is welded in a gas-tight manner.

The multi-pipe wall in accordance with the above presented description with one or several throughgoing points provides for a possibility of inserting various recesses till complete closure of the throughgoing point.

Figure 8:
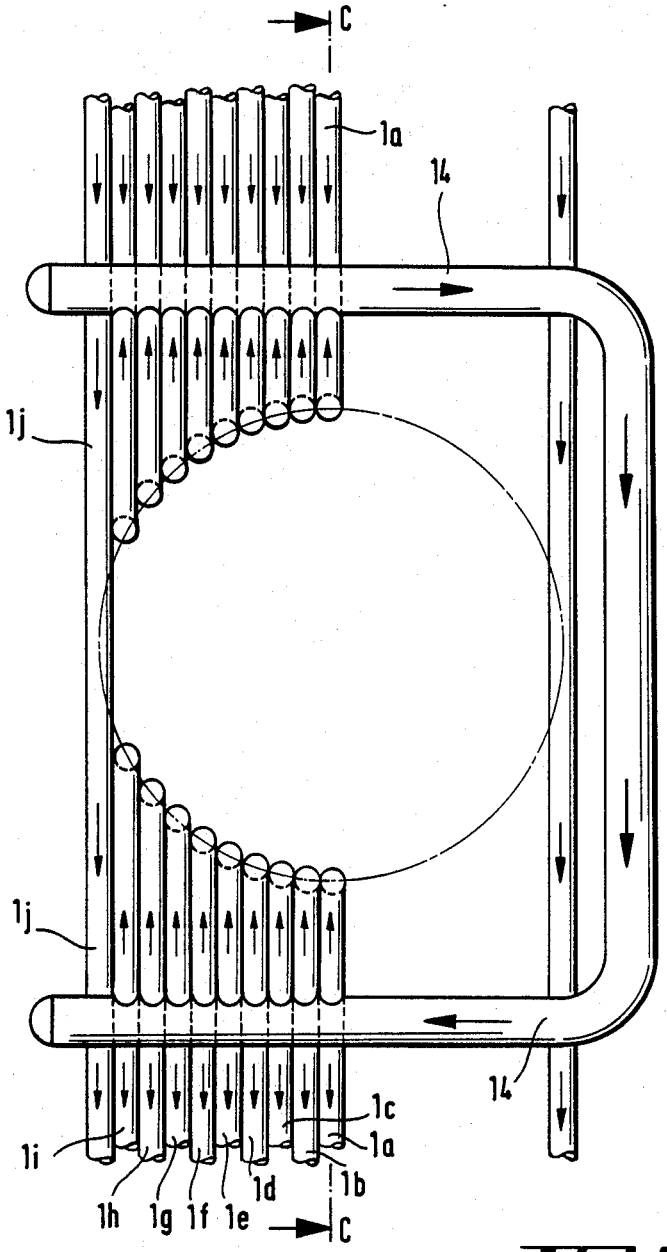
FIG. 8 is a view showing another embodiment of the throughgoing point.
Figure 9:
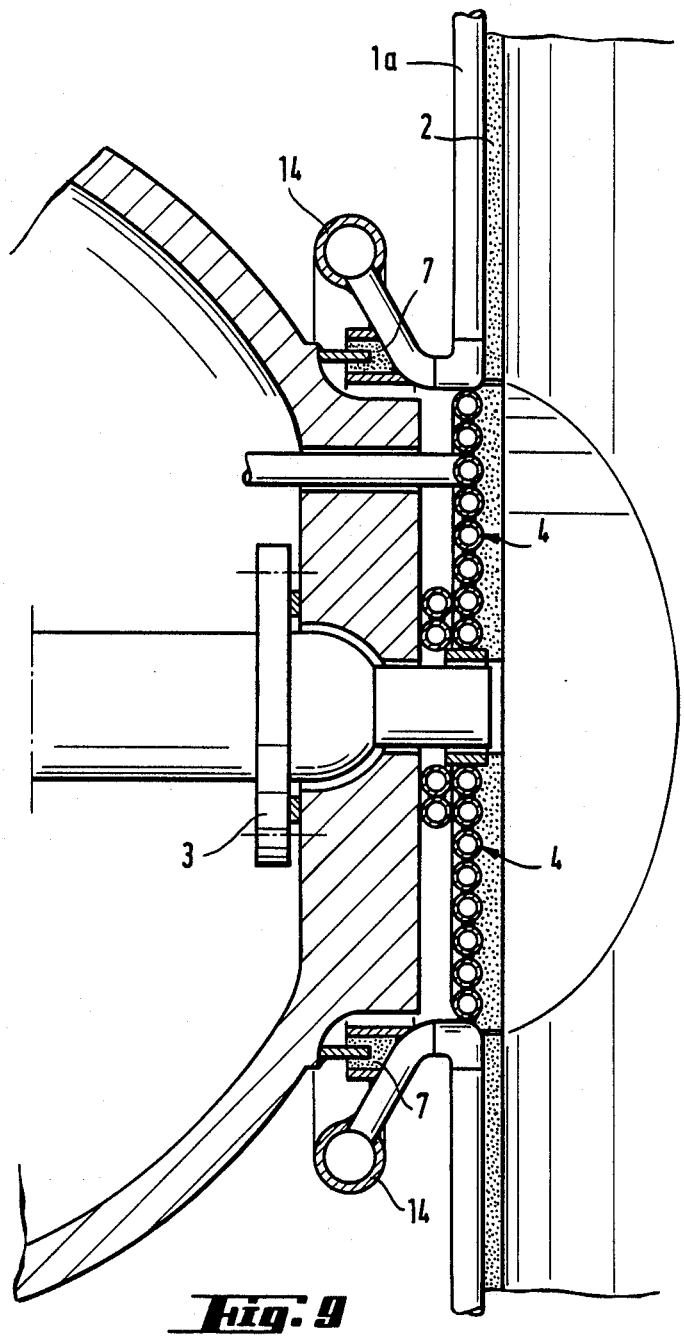
FIG. 9 is a view showing a section taken along the line C—C in FIG. 8.

Another embodiment of the throughgoing point is shown in FIGS. 8 and 9. FIG. 8 is a front view of the throughgoing point as seen from the burner onto the multi-pipe wall, and FIG. 9 is a section taken along the line C—C in FIG. 8.

In deviation from the construction shown in FIG. 5, the pipes 1*a*–1*i* open into a collector 14, instead of forming a pipe collar. The collecting pipe 14 passes laterally on the throughgoing point as shown in FIG. 8 and supplies the lower half of the pipe at this point of the multi-pipe wall.

At the location where the pipes 1 deviate from the vertical downwardly extending row of the multi-pipe wall, the sealing system 7 can be provided to insure the gas-tightness from the inner gasifying chamber. This embodiment has a lower space consumption, is simpler in construction, and less expensive than the embodiment of FIGS. 5–7, and therefore is especially advantageous. Instead of one collecting pipe, two semi-circular pipes can be provided.

Figure 10:
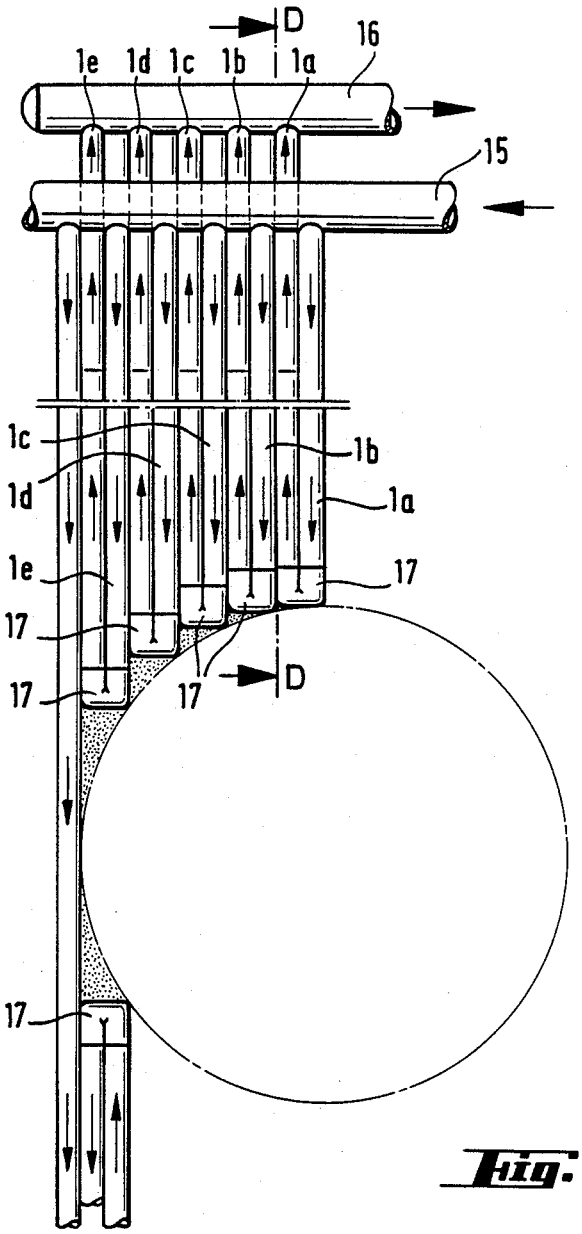
FIG. 10 is a partial view of a further embodiment of the throughgoing point.
Figure 11:
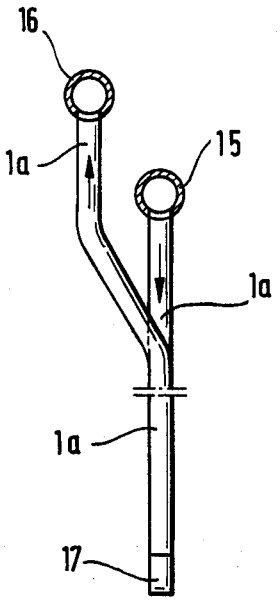
FIG. 11 is a view showing a section taken along the line D—D in FIG. 9.

A further advantageous embodiment for the inserted construction at the throughgoing point is shown in FIG. 10. At the location of the pipe collar or collector pipes, a supply pipe 15 and withdrawal pipe 16 are provided. The cooling water flows from the supply pipe 15 into the pipes 1*a*–1*e*. At the height of the periphery of the throughgoing point, the cooling water stream at the lower end of the pipes 1*a*–1*e* is deflected from the downward and upward flow direction by a plurality of angular shaped pieces 17 which lie in alignment with the throughgoing point on the periphery of the cylindrical multi-pipe structure. Thereby the water flow discharges via the withdrawal pipe 16. FIG. 11 shows the section taken along the line D—D in FIG. 10, with the supply and withdrawal pipes 15 and 16 which are offset relative to one another.

When on the grounds of the gasification technique the utilization of a changeable recess must be dispensed with, the throughgoing point is closed by a structural part which corresponds to the design of the multi-pipe wall and contains the burner.

Figure 12:
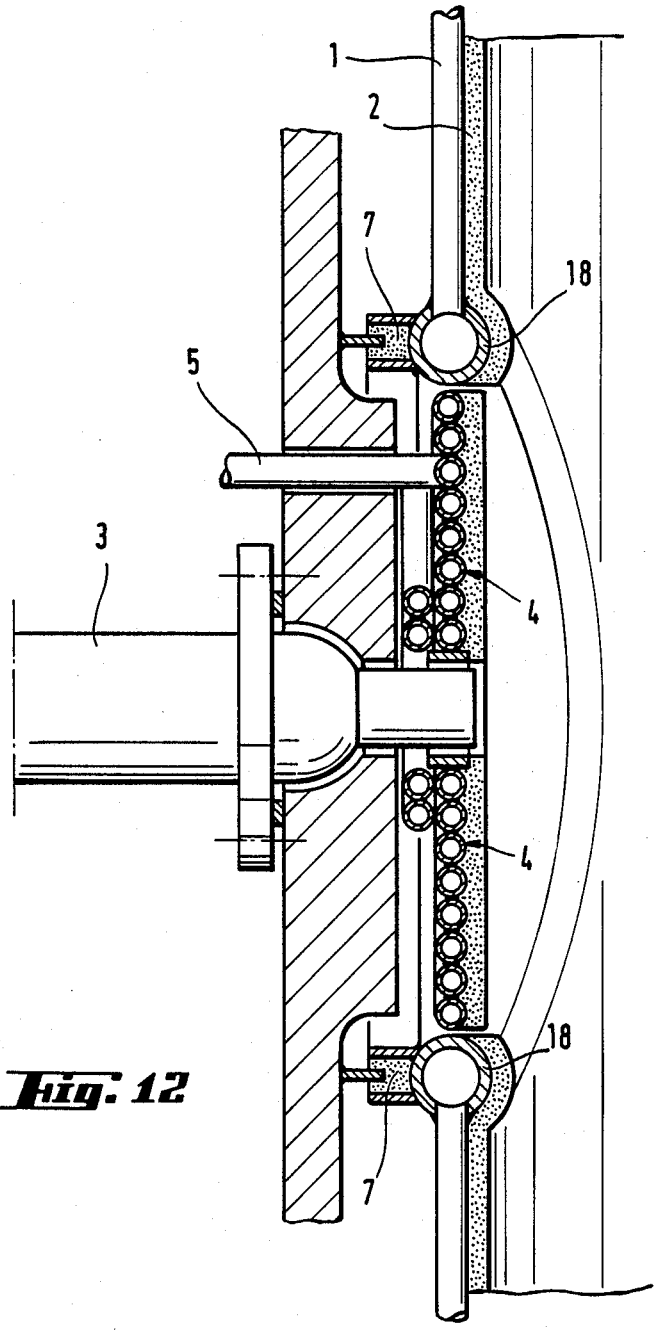
FIG. 12 is a view showing a section through a closure for the throughgoing point.
Figure 14:
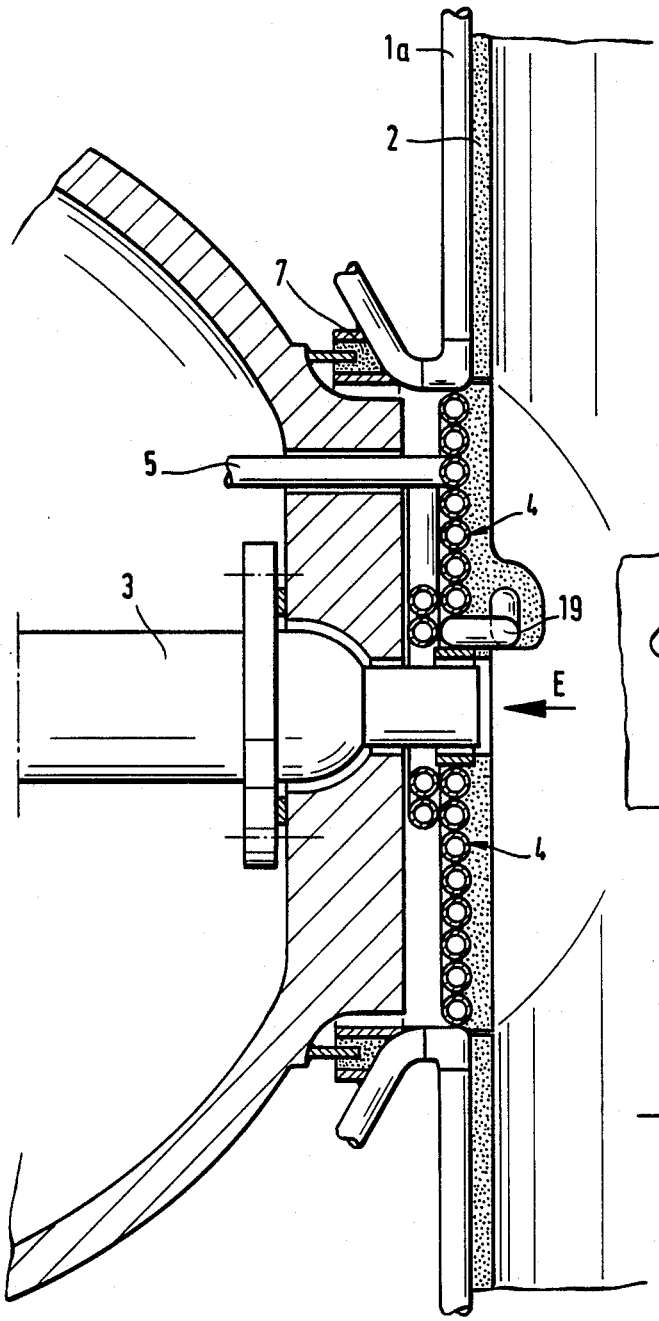
FIG. 14 is a front view of FIG. 13.

FIG. 12 shows such a closure for a throughgoing point in the cylindrical multi-pipe wall. Here the vertically downwardly extending pipe 1 opens into a ring collector 18 which is formed on the periphery of the throughgoing point and integrated in the multi-pipe wall. Its cross section is selected so that a flow speed of the cooling water required for a sufficient cooling is achieved. The sealing system 7 is mounted on this ring collector, in deviation from other embodiments of the invention.

Figure 13:
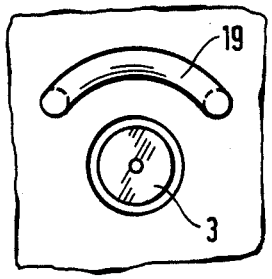
FIG. 13 is a view showing a section showing another closure for a throughgoing point with a slag-deflecting protective shield.

In the multi-pipe wall with the closed recess or with a recess of smaller depth, the burner opening poses the danger from liquid fuel slag which runs from the walls of the multi-pipe wall structure at the gasification temperature over 2000° C. In accordance with a further feature of the present invention, this danger is eliminated by the incorporation of one or several tubular pieces 19 extending from the multi-pipe wall. Cooling water of the multi-pipe wall 4 flows thorugh the tubular pieces 19 so as to form a protective shield over the burner opening and prevent its filling with slag. FIG. 13 shows a section of the slag-deflecting protective shield formed by the tubular piece 19 with the protecting layer of a fire resistant material.

It will be understood that each of the elements described above, or two or more together, may also find a useful application in other types of constructions differing from the types described above.

While the invention has been illustrated and described as embodied in an arrangement for gasifying finely divided, particularly solid fuels under high pressure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for gasifying finely divided, particularly solid fuel under increased pressure, comprising a multi-pipe wall having a plurality of pipes arranged to be supplied with a cooling medium, said multi-pipe wall limiting a gas-collecting chamber and also limiting a plurality of recesses which form combustion chambers, each of said recesses having a plurality of parameters including a depth, a width and an angle of inclination of a peripheral wall and being such that at least one of said parameters is changeable in accordance with operational conditions, said multi-pipe wall including a plurality of first multi-pipe wall portions which limit said recesses and a second multi-pipe wall portion which limits said gas-collecting chamber and are disconnectable and releasable from one another so that at least one of said first multi-pipe wall portions which limits one of said recesses can be removed and replaced by another different first multi-pipe wall portion which limits another different recess; and means for disconnectably and releasably attaching said at least one first multi-pipe wall portion to said second multi-pipe wall portion.

2. An arrangement as defined in claim 1; and further comprising means for withdrawing a gas from said gas-collecting chamber above the latter.

3. An arrangement as defined in claim 1; and further comprising means for withdrawing a slag from said gas-collecting chamber under the latter.

4. An arrangement as defined in claim 1; and further comprising means for supplying a cooling medium into said pipes of said multi-pipe wall.

5. An arrangement as defined in claim 1, wherein said gas-collecting chamber has a chamber wall, the depth of each said recesses being changeable by arranging of said multi-pipe wall at different distances from said chamber wall.

6. An arrangement as defined in claim 1, wherein said collecting chamber has a chamber wall, said recesses having recess walls of different diameters, the width of said recesses being changeable by inserting into said chamber wall of recess walls of different diameters.

7. An arrangement as defined in claim 1, wherein said collecting chamber has a chamber wall, said recesses having recess walls with different angles of inclination, the angle of inclination of said recesses being changeable by inserting into said chamber wall of recess walls of different angles of inclination.

8. An arrangement as defined in claim 1, wherein said multi-pipe wall portions are provided with independent cooling supply and withdrawal means.

9. An arrangement as defined in claim 1, wherein said second multi-pipe wall portion of said gas-collecting chamber has a throughgoing point formed so that said at least one first multi-pipe wall portion of said one recess can be placed therein.

10. An arrangement as defined in claim 9, wherein said throughgoing point is formed by bending of pipes of said second multi-pipe wall portion of said gas-collecting chamber so as to form a pipe collar.

11. An arrangement as defined in claim 9, wherein said throughgoing point is formed by said pipes of said second multi-pipe wall portion of said gas-collecting chamber by bending said pipes; and further comprising a collecting pipe which is arranged prior to said throughgoing point and in which said pipes of said second multi-pipe wall portion are open in the region of said throughgoing point.

12. An arrangement as defined in claim 9, wherein said throughgoing point is formed by said pipes of said second multi-pipe wall portion of said gas-collecting chamber which are bent; and further comprising a collecting pipe in which said pipes of said second multi-pipe wall portion are open and which forms a periphery of said throughgoing point.

13. An arrangement as defined in claim 9, wherein said throughgoing point is formed by said pipes of said second multi-pipe wall portion of said gas-collecting chamber; and further comprising a plurality of angular-shaped members in which said pipes of said second multi-pipe wall portion are open in the region of said throughgoing point.

14. An arrangement as defined in claim 9, wherein said throughgoing point has a periphery; and further comprising a sealing system provided over said periphery of said throughgoing point for sealing said recesses from said gas-collecting chamber.

15. An arrangement as defined in claim 9, wherein said throughgoing point is closable; and further comprising means for closing said throughgoing point and including a cover plate provided with cooling pipes.

16. An arrangement as defined in claim 15; and further comprising a burner arranged on said cover plate; and means for protecting of said burner from a slag and including a slag-deflecting protective shield.

17. An arrangement as defined in claim 16, wherein said slag-deflecting shield is formed by pipe pieces projecting from said cover plate.

18. An arrangement as defined in claim 15, wherein said pipe pieces are provided with a layer of a fire-resistant material.

19. An arrangement for gasifying finely divided, particularly solid fuel under increased pressure, comprising a multi-pipe wall having a plurality of pipes arranged to be supplied with a cooling medium, said multi-pipe wall limiting a gas-collecting chamber and also limiting a plurality of recesses which form combustion chambers, each of said recesses having a plurality of parameters including a depth, a width and an angle of inclination of a peripheral wall and being such that at least one of said parameters is changeable in accordance with operational conditions, said multi-pipe wall including a plurality of first multi-pipe wall portions which limit said recesses and a second multi-pipe wall portion which limits said gas-collecting chamber and are disconnectable and releasable from one another so that at least one said first multi-pipe wall portions which limits one of said recesses can be removed and replaced by another different first multi-pipe wall portion which limits another different recess; means for disconnectably and releasably attaching said at least one first multi-pipe wall portion to said second multi-pipe wall portion, said second multi-pipe wall portion of said gas-collecting chamber having a throughgoing point formed so that said one first multi-pipe wall portion of said recesses can be placed therein, said throughgoing point being closeable; and means for closing said throughgoing point and including a cover plate provided with cooling pipes.

* * * * *